US009663213B2

(12) United States Patent
Yoshikawa

(10) Patent No.: US 9,663,213 B2
(45) Date of Patent: May 30, 2017

(54) OUTBOARD MOTOR ANTI-THEFT SECURITY SYSTEM

(71) Applicant: SUZUKI MOTOR CORPORATION, Hamamatsu-shi, Shizuoka (JP)

(72) Inventor: Yukihiro Yoshikawa, Hamamatsu (JP)

(73) Assignee: SUZUKI MOTOR CORPORATION, Hamamatsu-shi, Shizuoka (JP)

( * ) Notice: Subject to any disclaimer, the term of this patent is extended or adjusted under 35 U.S.C. 154(b) by 0 days.

(21) Appl. No.: 14/995,595

(22) Filed: Jan. 14, 2016

(65) Prior Publication Data

US 2016/0207604 A1 Jul. 21, 2016

(30) Foreign Application Priority Data

Jan. 20, 2015 (JP) ..... 2015-008770

(51) Int. Cl.
*B63J 99/00* (2009.01)
*B63B 17/00* (2006.01)

(52) U.S. Cl.
CPC ..... *B63J 99/00* (2013.01); *B63B 2017/0009* (2013.01); *B63J 2099/006* (2013.01)

(58) Field of Classification Search
CPC ..... G06F 7/00; B63J 99/00; B63H 21/22
See application file for complete search history.

(56) References Cited

U.S. PATENT DOCUMENTS 6,077,133 A * 6/2000 Kojima ..... B63J 99/00 440/1
6,352,045 B1 * 3/2002 Takashima ..... B60R 25/04 114/55.5
2002/0151230 A1 * 10/2002 Kanno ..... B63J 99/00 440/84
2010/0049385 A1 * 2/2010 Bamba ..... B63H 21/22 701/21
2011/0136398 A1 * 6/2011 Takeda ..... B63J 99/00 440/1
2011/0137500 A1 * 6/2011 Shinogi ..... B63J 99/00 701/21

FOREIGN PATENT DOCUMENTS

JP 2011-121448 A 6/2011

* cited by examiner

*Primary Examiner* — Thomas Tarcza
*Assistant Examiner* — Alex C Dunn
(74) *Attorney, Agent, or Firm* — Troutman Sanders LLP

(57) ABSTRACT

The authentication unit stores information for causing the outboard motor control unit to permit an engine start in order to enable setting of an unlock state in which the engine start is permitted without authentication of ID information of an electronic key and a child lock state in which the engine start is permitted by performing a predetermined release operation without necessity of authenticating the ID information of the electric key.

2 Claims, 7 Drawing Sheets

OUTBOARD MOTOR ANTI-THEFT SECURITY SYSTEM

CROSS-REFERENCE TO RELATED APPLICATION

This application is based upon and claims the benefit of priority of the prior Japanese Patent Application No. 2015-008770, filed on Jan. 20, 2015, the entire contents of which are incorporated herein by reference.

BACKGROUND OF THE INVENTION

Field of the Invention

The present invention relates to an anti-theft security system equipped in an outboard motor mounted on a ship and the like to suitably prevent a theft.

Description of the Related Art

There is known a so-called smart keyless entry system as an anti-theft security system equipped in a vehicle such as an automobile. In this system, when an engine stops, a lock state is automatically set by a program embedded in a keyless controller or an engine control module (ECM) in order to disable an engine start without a portable key unit (electronic key). Meanwhile, for example, if a user loses the portable key unit while a ship is at anchor in a sea offshore, it is impossible to start an engine, and the ship may drift about. In order to avoid such a trouble, in some systems, an unlock state is set instead of a lock state while a ship is at anchor in an offshore. In these systems, an operator may start an engine even when the portable key unit is lost.

For example, one of such a type of ship anti-theft security systems or devices has been discussed in Japanese Laid-open Patent Publication No. 2011-121448.

In some systems of the prior art, both the mechanical ignition key switch and the portable key unit may be employed in a combined manner. In these systems, an ignition-on operation is performed by the mechanical ignition key switch, and switching between the lock state and the unlock state is performed by pressing a button of the portable key unit. By setting the unlock state instead of the lock state while a ship is at anchor in an offshore, the engine can start even when the portable key unit is lost.

CITATION LIST

Patent Documents

[Patent Document 1] Japanese Laid-open Patent Publication No. 2011-121448

SUMMARY OF THE INVENTION

However, since the unlock state is set when a ship is at anchor in an offshore as described above, the engine may unintentionally start, for example, by an erroneous switch manipulation of a child or a careless manipulation of a crew. In this case, the ship may suddenly start, and this may significantly affect a ship steering control without any prevention. In such a type of systems, it is very important to obtain usability or safety while guaranteeing proper anti-theft security.

In view of the aforementioned problems, it is therefore an object of the present invention to provide an outboard motor anti-theft security system having excellent usability and guaranteeing high safety.

According to an aspect of the present invention, there is provided an outboard motor anti-theft security system including: an outboard motor control unit that controls operations of an outboard motor mounted with an engine; an electronic key that stores ID information; and an authentication unit that obtains the ID information from the electronic key and determines whether or not the obtained ID information is identical to authentication ID information, the outboard motor control unit being permitted to start the engine when it is determined that the obtained ID information is identical to the authentication ID information in order to prevent a theft of the outboard motor, wherein the authentication unit causes the outboard motor control unit to store information for permitting the engine start so as to enable setting of an unlock state in which the engine start is permitted without authenticating ID information of the electronic key, and a child lock state in which the engine start is permitted by performing a predetermined release operation without necessity of authentication of the ID information of the electronic key.

According to another aspect of the present invention, there is provided an outboard motor anti-theft security system including: an outboard motor control unit that controls operations of an outboard motor mounted with an engine; an electronic key that stores ID information; and an authentication unit that obtains the ID information from the electronic key and determines whether or not the obtained ID information is identical to authentication ID information, the outboard motor control unit being permitted to start the engine when it is determined that the obtained ID information is identical to the authentication ID information in order to prevent a theft of the outboard motor, wherein an authentication unit activation/deactivation switch for activating the authentication unit to initiate communication with the electronic key and deactivating the authentication unit and an engine start/stop switch for starting the engine by activating an engine starter motor and stopping the engine are provided separately.

In the outboard motor anti-theft security system according to the present invention, an authentication unit activation/deactivation switch for activating the authentication unit to initiate communication with the electronic key and deactivating the authentication unit, an engine start/stop switch for starting the engine by activating an engine starter motor and stopping the engine, and a child lock switch for setting a child lock state may be provided separately.

In the outboard motor anti-theft security system according to the present invention, the authentication unit activation/deactivation switch and the engine start/stop switch may be button type switches, a starter motor driving circuit that drives the starter motor activated by the engine start/stop switch may be provided with a latch circuit for maintaining an operation state for a predetermined time period until the engine is started, and pressing time periods of the authentication unit activation/deactivation switch and the engine start/stop switch for deactivating the authentication unit and restarting the engine from the unlock state may be set to be longer than those for activating the authentication unit and stopping the engine.

DETAILED DESCRIPTION OF THE PREFERRED EMBODIMENTS

A description will now be made for an outboard motor anti-theft security system according to a preferable embodiment of the present invention with reference to the accompanying drawings.

Figure 1:
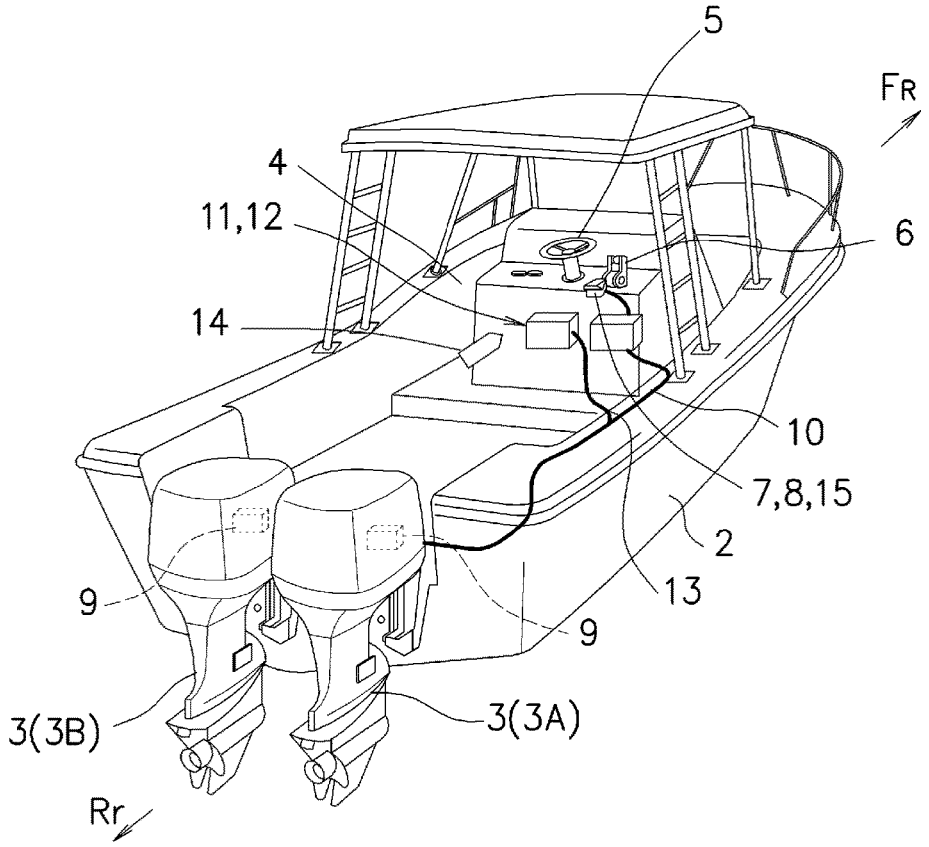
FIG. 1 is a perspective view illustrating a ship as an application according to an embodiment of the present invention as seen from the back side with an inclination.

FIG. 1 is a perspective view illustrating a ship 1 as an application of the present invention as seen from the back with an inclination. First, a configuration of the entire ship 1 will be described in brief with reference to FIG. 1. It is noted that, in the drawings used in the following description including FIG. 1, a front direction of the ship will be denoted by "Fr," and a rear direction of the ship will be denoted by "Rr."

As illustrated in FIG. 1, a plurality of outboard motors 3 each having an engine (a pair of outboard motors 3A and 3B in this example) are installed to a transom placed in a rear portion of the hull 2 of the ship 1 by using brackets.

A wheelhouse 4 is provided in front of the hull 2. The wheelhouse 4 has a steering handle 5, a remote control lever 6, an ignition switch 7, and a child lock switch 8. Meanwhile, the outboard motor 3 is provided with an engine control module (ECM) 9, and the ignition switch 7 and the child lock switch 8 are connected to the ECM 9 of the outboard motor 3 (outboard motors 3A and 3B, respectively) through a CAN line 10.

A keyless controller 12 connected to the ECM power relay 11 (refer to FIG. 2) is mounted and is connected to the ECM 9 of the outboard motor 3 through the CAN line 13. Communication of predetermined identification (ID) information stored in an electronic key 14 (portable key unit) possessed by a ship operator is performed between the keyless controller 12 and the electronic key 14. It is noted that an emergency stop switch 15 for emergency stop is equipped.

A ship operator can steer the ship 1 by manipulating the steering handle 5 and the remote control lever 6 in a normal operation.

Figure 2:
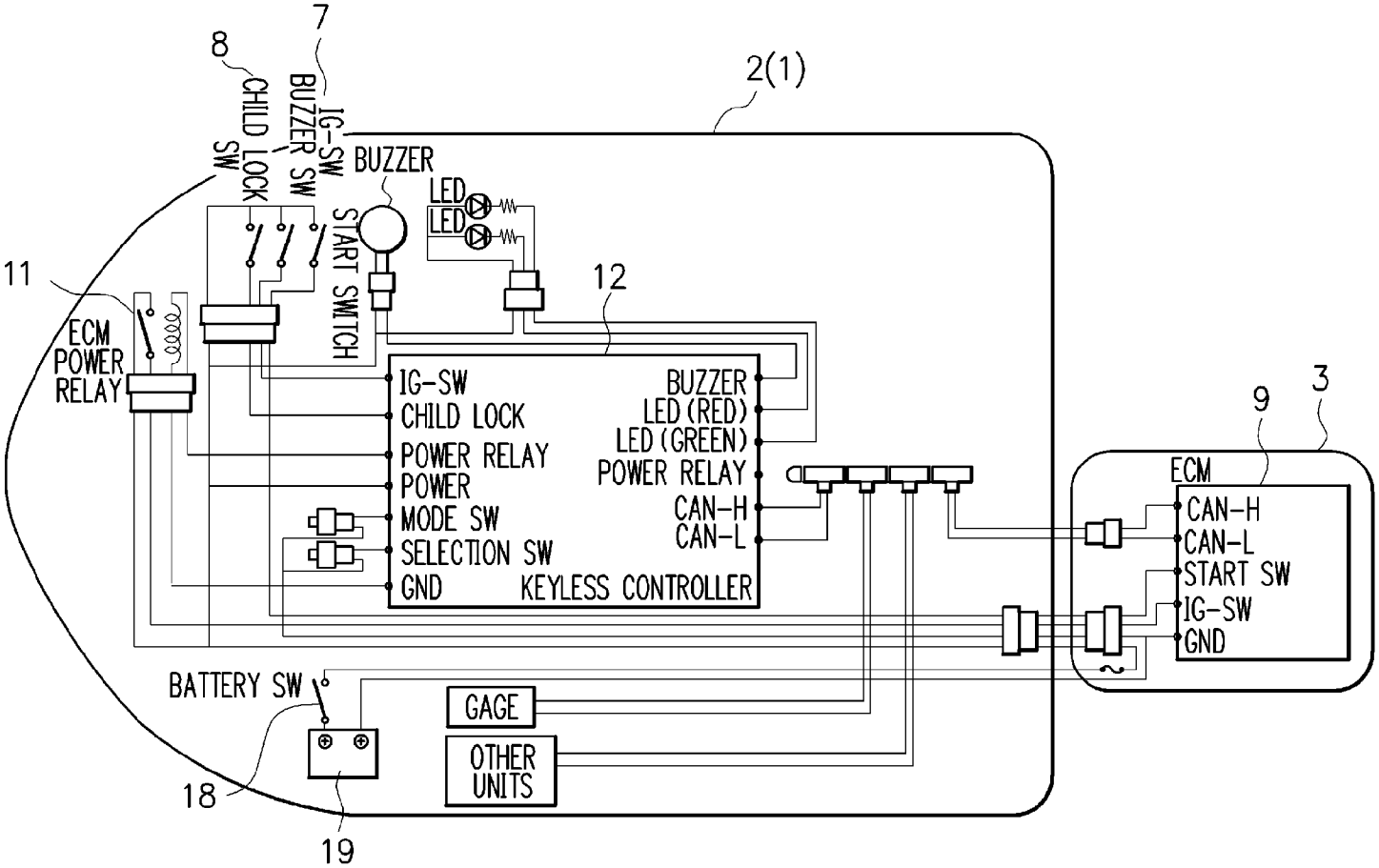
FIG. 2 is a block diagram illustrating a configuration of a ship steering system according to an embodiment of the present invention.

Here, FIG. 2 is a block diagram illustrating a configuration of the ship steering system. In the ship steering system according to this embodiment, a shift operation, a throttle operation, and a steering operation of the outboard motors 3A and 3B can be changed by electrically controlling the outboard motors 3A and 3B based on the manipulation information from the steering handle 5 and the remote control lever 6.

The outboard motor 3 according to the present invention is provided with an anti-theft security system capable of preventing a theft of the outboard motor 3 by authenticating the electronic key 14. The anti-theft security system according to this embodiment includes an ECM 9 as an outboard motor control unit for controlling operations of the outboard motor 3 having an engine, an electronic key 14 that stores ID information, and a keyless controller 12 as an authentication unit that obtains ID information from the electronic key 14 and determines whether or not the obtained ID information is identical to authentication ID information. In addition, in the keyless controller 12, if it is determined that the obtained ID information is identical to the authentication ID information, an engine start is permitted for the outboard motor control unit. As a result, it is possible to prevent a theft of the outboard motor 3.

In the aforementioned configuration, the keyless controller 12 as an authentication unit stores information for permitting an engine start in the ECM 9 as an outboard motor control unit. The keyless controller 12 is allowed to set an unlock state in which the engine start is permitted without any authentication of the ID information of the electronic key 14 and a child lock state in which the engine start is permitted through a predetermined release operation without necessity of authentication for the ID information of the electronic key 14.

As described below in more detail, the anti-theft security system is separately provided with an authentication unit activation/deactivation switch for activating the authentication unit to initiate communication with the electronic key 14 and deactivating the authentication unit, an engine start/stop switch for activating the engine starter motor to start the engine and stopping the engine, and a child lock switch 8 for setting the child lock state.

Figure 3:
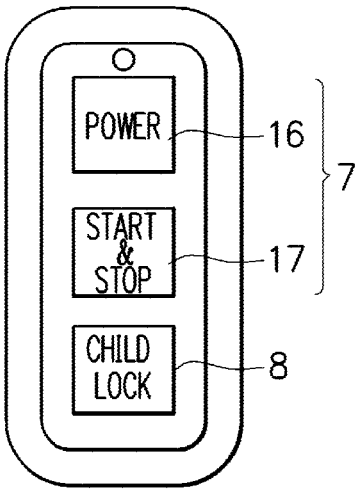
FIG. 3 is a diagram illustrating a specific configuration example of a switch including an ignition switch and a child lock switch according to an embodiment of the present invention.

FIG. 3 illustrates a specific configuration example of the switch module including the ignition switch 7 and the child lock switch 8 according to this embodiment. The switch module includes a power button 16 corresponding to the activation/deactivation switch of the keyless controller 12 (authentication unit) as the ignition switch 7, a start button 17 corresponding to the engine start/stop switch, and a child lock switch 8.

According to this embodiment, the power button 16 and the start button 17 are press button type switches.

The starter motor driving circuit for driving the engine starter motor activated by the start button 17 is provided with a latch circuit (holding circuit) for maintaining a driving state for a certain time period (t) until the engine of the outboard motor 3 starts.

Furthermore, pressing time periods ($t_1$ and $t_2$) of the authentication unit activation/deactivation switch (power button 16) and the engine start/stop switch (start button 17) for deactivating the authentication unit and restarting the engine from the unlock state are set to be longer than those for activating the authentication unit and stopping the engine.

Figure 4:
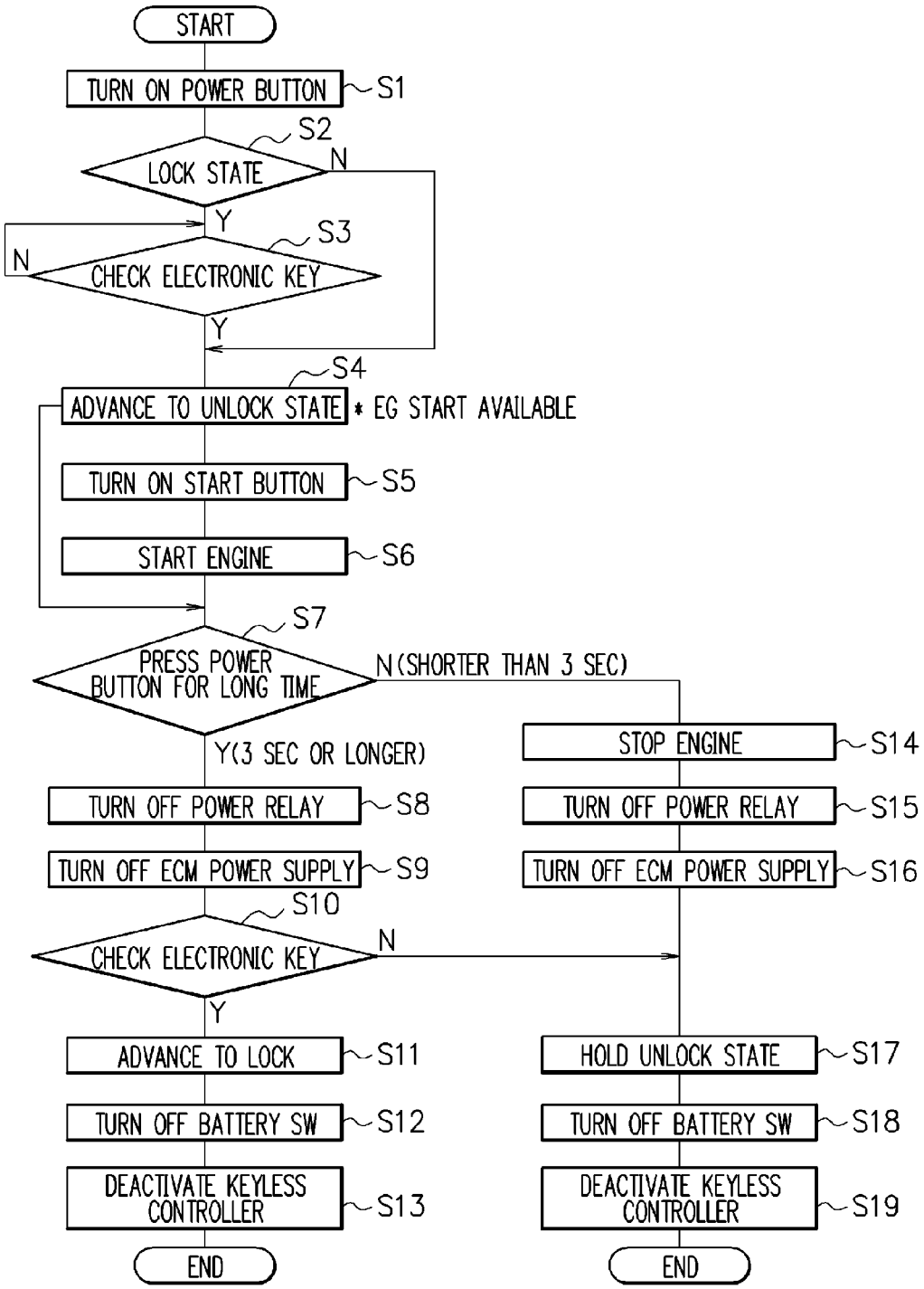
FIG. 4 is a flowchart illustrating operations of an anti-theft security system according to an embodiment of the present invention.

Next, a description will be made for operations of the anti-theft security system according to this embodiment with reference to the flowchart of FIG. 4. First, the keyless controller 12 has a standby state as the battery switch 18 is turned on. In step S1, as the power button 16 is pressed, the keyless controller 12 is activated. In step S2, it is determined whether the anti-theft security system has the lock state or the unlock holding state. If it is determined that the anti-theft security system has the unlock holding state, the unlock state is set, in which the engine start is permitted without checking the electronic key 14. If it is determined that the anti-theft security system has the lock state, communication is performed with the electronic key 14 possessed by a ship operator to check an authentication number in step S3. If the authentication is successful, the anti-theft security system advances to the unlock state for permitting the engine start from the lock state (in step S4). Specifically, the ECM power relay 11 is turned on, and power is supplied to the ECM 9 of the outboard motor 3 or engine accessories (such as a fuel pump).

Under this state, in step 5, as the start button 17 of the ignition switch 7 is pressed to be turned on, the starter motor is operated to start the engine (step S6). In this case, a driving state is maintained for a time period "t" from the pressing of the start button 17 to the engine start by using the latch circuit of the starter motor driving circuit.

Then, in the power off operation, in order to set the anti-theft security system to the lock state (in which the anti-theft security system is deactivated), in step S7, the power button 16 of the ignition switch 7 is pressed for a long time (for example, three seconds or longer (time period $t_1$)) while the engine is driven (also including the unlock state in which the engine start is allowable). As a result, in step S11, the keyless controller 12 is set to the lock state. However, in this case, the ECM power relay 11 is turned off by using the keyless controller 12 to cut off the power to the ECM 9 (steps S8 and S9) and disable the engine start.

It is noted that, in order to set the lock state, the electronic key 14 is checked (step S10). If the authentication is successful, the lock state is set (step S11). Alternatively, any check may not be performed. That is, the check of the electronic key 14 in this case is optional as necessary.

Then, in step S12, the battery switch 18 (refer to FIG. 2) is turned off, so that power from the battery 19 is cut off. In step S13, the keyless controller 12 is deactivated. When the keyless controller 12 is activated in the next time, the operation is initiated in the lock state.

In order to set the anti-theft security system to the unlock state (in which the engine start is possible without a check of the authentication number), the power button 16 of the ignition switch 7 is pressed for a short time (for example, shorter than three seconds) while the engine is driven (including a state that the authentication of the electronic key 14 is successful, but the engine is not started yet) in step S7. As a result, the engine stops (in step S14), and in step S17, the keyless controller 12 maintains the unlock state. However, in this case, the ECM power relay 11 is turned off by the keyless controller 12 to cut off the power to the ECM 9 (in steps S15 and S16). When the keyless controller 12 is activated in the next time, the operation is initiated in the unlock state.

Figure 5:
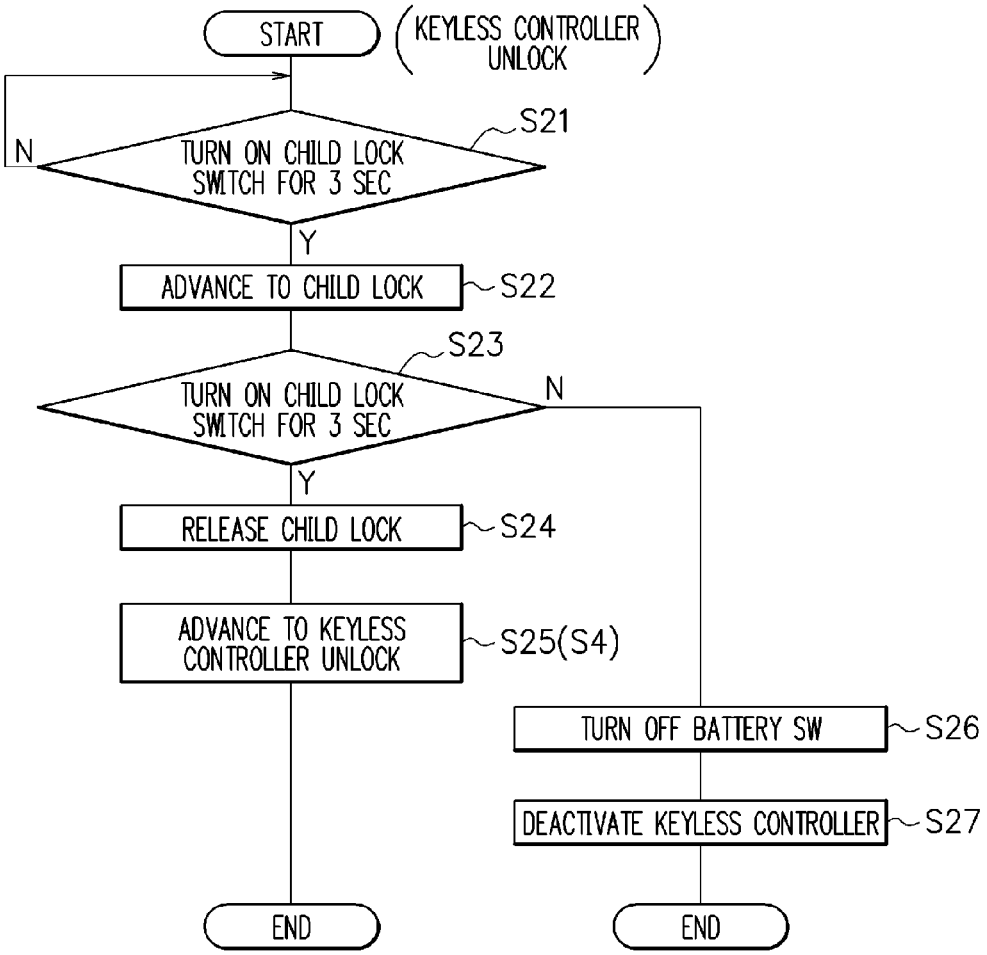
FIG. 5 is a flowchart illustrating operations of an anti-theft security system according to an embodiment of the present invention when a child lock is set.

In order to set the keyless controller 12 of the anti-theft security system from the unlock state to the child lock state, first, the anti-theft security system is activated in the unlock state as illustrated in FIG. 5. Under the unlock state, the child lock switch 8 is turned on in step S21 (for example, by pressing the child lock switch 8 for a long time such as three seconds or longer). As a result, it is possible to set the child lock state (step S22).

Under the child lock state, the engine is not started even by pressing the start button 17 and the power button 16 of the ignition switch 7. Therefore, it is possible to prevent the engine from erroneously starting, for example, by an erroneous switch manipulation of a child when the ship is at anchor in an offshore.

Meanwhile, in order to release the child lock state, in step S23, the child lock switch 8 is turned on again (for example, by pressing it for a long time such as three seconds or longer). As a result, in step S24, the child lock state is released. In addition, in step S25, the keyless controller 12 advances to the unlock state (step S4).

It is noted that, if there is no manipulation of the child lock switch 8 to be turned on in step S23, the battery switch 18 is turned off in step S26 while the child lock state is maintained. Therefore, the power supplied from the battery 19 is cut off, and the keyless controller 12 is deactivated (step S27). When the keyless controller 12 is activated in the next time, the operation is initiated in the unlock state.

Figure 6:
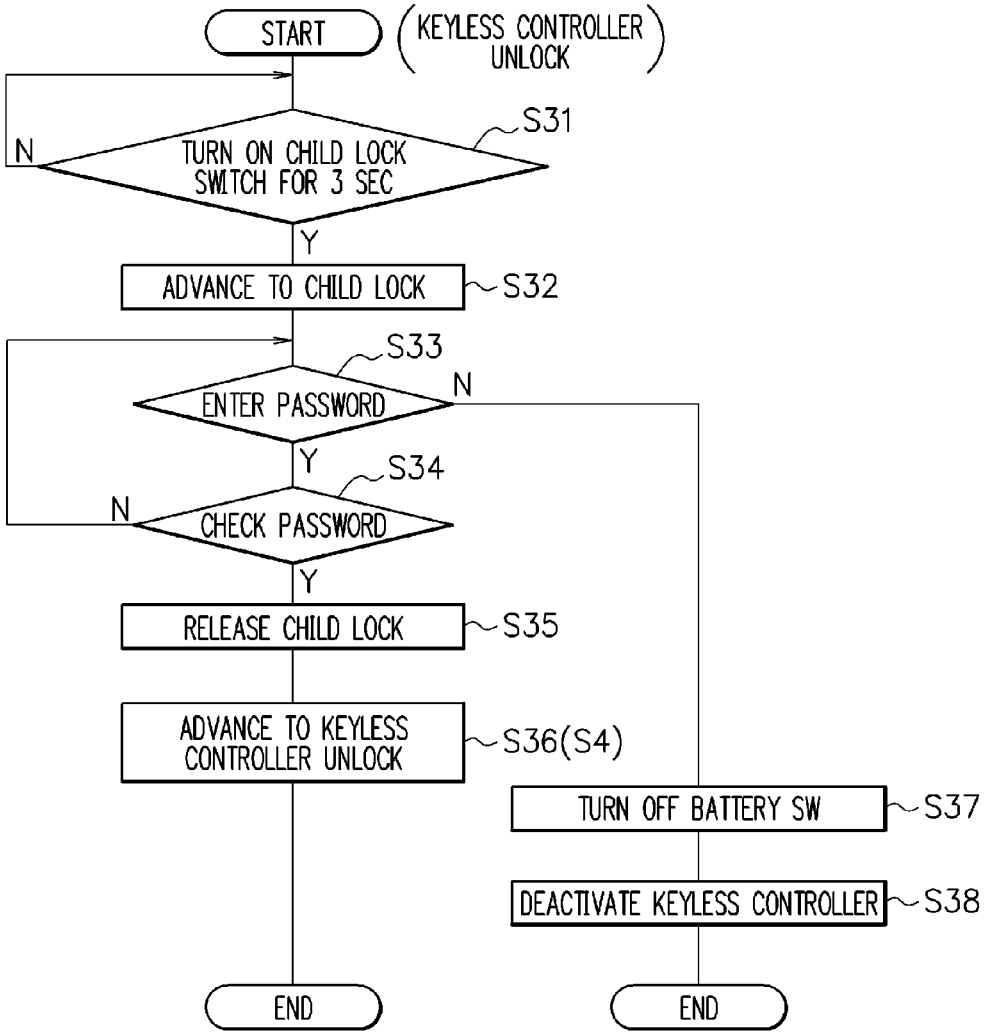
FIG. 6 is a flowchart illustrating operations of another anti-theft security system according to an embodiment of the present invention when a child lock is set.

Alternatively, the child lock state may be released by using a password. In FIG. 6, first, the operation is initiated while the anti-theft security system is set to the unlock state. Under the unlock state, in step S31, the child lock switch 8 is turned on (for example, by pressing it for a long time such as three seconds or longer). As a result, it is possible to advance to the child lock state (step S32).

Under the child lock state, the engine is not started even by pressing the start button 17 and the power button 16 of the ignition switch 7.

Meanwhile, in order to release the child lock state, a password preset in step S33 is input, and the preset password is checked (step S34). If the password is right, the child lock is released (step S35). In addition, in step S36, the keyless controller 12 is set to the unlock state (step S4).

Here, the password input may be performed by manipulating (ON/OFF) the child lock switch 8 with a predetermined pattern. As a specific example of the password input method, for example, a two-digit number may be employed. In this case, in step S33, the child lock switch 8 is pressed (ON) by the number corresponding to the first digit of the password. If the first digit is successfully authenticated, the child lock switch 8 is pressed (ON) by the number corresponding to the second digit. If the second digit is successfully authenticated, it is determined that the password is finally successfully authenticated. As a result, the child lock is released.

It is noted that, if there is no password input in step S33, the battery switch 18 is turned off in step S37 while the child lock state is maintained. Therefore, the power supplied from the battery 19 is cut off, and the keyless controller 12 is deactivated (step S38). When the keyless controller 12 is activated in the next time, the operation is initiated in the unlock state.

In the outboard motor anti-theft security system according to a second embodiment of the present invention, an anti-theft security system activation/deactivation switch and a switch for setting the unlock state are provided separately.

Figure 7:
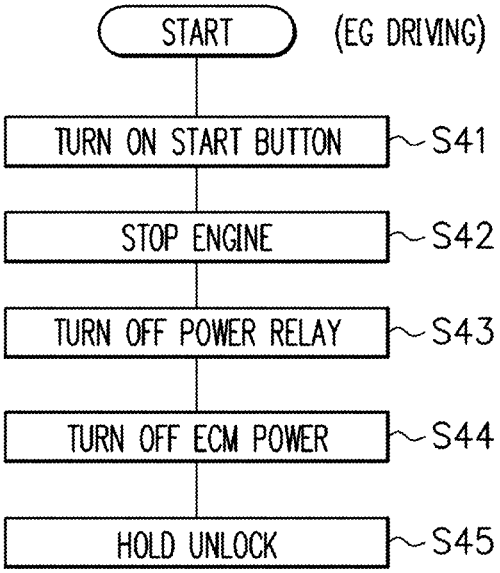
FIG. 7 is a flowchart illustrating operations of an anti-theft security system according to a second embodiment of the present invention.

A description will be made for operations of the anti-theft security system according to the second embodiment with reference to the flowchart of FIG. 7. When the anti-theft security system is set to the unlock state (in which the engine start is enabled without checking the authentication number), the operation is initiated while the engine is driven (including a state that the authentication of the electronic key 14 is successful, but the engine is not started yet). As an operator presses the start button 17 of the ignition switch 7 (step S41), the engine stops in step S42. The keyless controller 12 maintains the unlock state as in step S45, but the ECM power relay 11 is turned off by the keyless controller 12 to cut off the power supplied to the ECM 9 (steps S43 and S44).

As the start button 17 is pressed under this state (for example, for a long time (time $t_2$) such as three seconds or longer), the ECM power relay 11 is turned on without checking the authentication number, so that the supply of power to the ECM 9 of the outboard motor 3 is resumed.

Therefore, it is possible to start the engine by activating the starter motor by pressing the start button 17.

According to the second embodiment, in particular, the button manipulated to activate or deactivate the anti-theft security system (power button 16) and the button manipulated to start or stop the engine (start button 17) are provided separately. As the engine stops by pressing the engine start/stop button, the unlock state is automatically set, in which authentication is not necessary. As a result, t is possible to prevent, in advance, an erroneous operation, such as erroneous setting of the lock state in which authentication is necessary.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

In the aforementioned embodiments of the present invention, the time period "t" relating to the latch circuit or the time periods "$t_1$" or "$t_2$" relating to the power button 16 and the start button 17, respectively, may be changed or modified as necessary.

According to the present invention, the mode changes from the unlock state to the child lock state as necessary. Under the child lock state, the engine is not started even by operating the authentication unit activation/deactivation switch and the engine start/stop switch. Meanwhile, the child lock state can be released as necessary. Therefore, it is possible to guarantee high safety depending on a use condition of the outboard motor.

What is claimed is:

1. An outboard motor anti-theft security system comprising:

an outboard motor control unit that controls operations of an outboard motor mounted with an engine;

an electronic key that stores ID information;

an authentication unit that obtains the ID information from the electronic key and determines whether or not the obtained ID information is identical to authentication ID information;

an authentication unit activation/deactivation switch activating the authentication unit to initiate communication with the electronic key and deactivating the authentication unit;

an engine start/stop switch starting the engine by activating an engine starter motor and stopping the engine;

a child lock switch setting a child lock state; and a starter motor driving circuit that drives the starter motor activated by the engine start/stop switch and comprises a latch circuit maintaining an operation state for a predetermined time period until the engine is started, wherein the outboard motor control unit being permitted to start the engine when it is determined that the obtained ID information is identical to the authentication ID information in order to prevent a theft of the outboard motor, wherein the authentication unit causes the outboard motor control unit to store information for permitting the engine start so as to enable setting of an unlock state in which the engine start is permitted without authenticating ID information of the electronic key, and a child lock state in which the engine start is permitted by performing a predetermined release operation without necessity of authentication of the ID information of the electronic key, wherein authentication unit activation/deactivation switch, the engine start/stop switch, and child lock switch are provided separately, wherein the authentication unit activation/deactivation switch and the engine start/stop switch are button type switches, and wherein pressing time periods of the authentication unit activation/deactivation switch and the engine start/stop switch deactivating the authentication unit and restarting the engine from the unlock state are set to be longer than those activating the authentication unit and stopping the engine.

2. An outboard motor anti-theft security system comprising:

an outboard motor control unit that controls operations of an outboard motor mounted with an engine;

an electronic key that stores ID information; and an authentication unit that obtains the ID information from the electronic key and determines whether or not the obtained ID information is identical to authentication ID information, the outboard motor control unit being permitted to start the engine when it is determined that the obtained ID information is identical to the authentication ID information in order to prevent a theft of the outboard motor, wherein an authentication unit activation/deactivation switch for activating the authentication unit to initiate communication with the electronic key and deactivating the authentication unit and an engine start/stop switch for starting the engine by activating an engine starter motor and stopping the engine are provided separately, wherein the authentication unit activation/deactivation switch and the engine start/stop switch are button type switches, wherein a starter motor driving circuit that drives the starter motor activated by the engine start/stop switch is provided with a latch circuit for maintaining an operation state for a predetermined time period until the engine is started, and wherein pressing time periods of the authentication unit activation/deactivation switch and the engine start/stop switch for deactivating the authentication unit and restarting the engine from the unlock state are set to be longer than those for activating the authentication unit and stopping the engine.

* * * * *